US007775518B2

(12) United States Patent
Kondo

(10) Patent No.: US 7,775,518 B2
(45) Date of Patent: Aug. 17, 2010

(54) SHEET CARRYING DEVICE AND SHEET CARRYING METHOD

(75) Inventor: Hirofumi Kondo, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 77 days.

(21) Appl. No.: 12/174,778

(22) Filed: Jul. 17, 2008

(65) Prior Publication Data

US 2009/0057994 A1 Mar. 5, 2009

Related U.S. Application Data

(60) Provisional application No. 60/982,106, filed on Oct. 23, 2007, provisional application No. 60/969,133, filed on Aug. 30, 2007, provisional application No. 60/969,134, filed on Aug. 30, 2007.

(51) Int. Cl.
*B65H 7/02* (2006.01)

(52) U.S. Cl. ..... 271/227; 271/228

(58) Field of Classification Search ..... 271/227, 271/228

See application file for complete search history.

(56) References Cited

U.S. PATENT DOCUMENTS 5,322,273 A * 6/1994 Rapkin et al. ..... 271/227
5,471,290 A * 11/1995 Nagayama et al. ..... 399/371
5,697,609 A * 12/1997 Williams et al. ..... 271/228
6,059,285 A * 5/2000 Suga et al. ..... 271/228
6,739,590 B2 * 5/2004 Otsuka ..... 271/227
7,415,221 B2 * 8/2008 Parisi et al. ..... 399/107
2002/0060416 A1 * 5/2002 Dobberstein et al. ..... 271/227
2005/0035528 A1 * 2/2005 Suga et al. ..... 271/10.12
2006/0208416 A1 * 9/2006 Dejong et al. ..... 271/228
2007/0040326 A1 * 2/2007 Noda et al. ..... 271/227
2008/0006992 A1 * 1/2008 Inoue ..... 271/228
2009/0057992 A1 * 3/2009 Katou et al. ..... 271/227
2009/0160125 A1 * 6/2009 Fujita et al. ..... 271/227
2009/0224465 A1 * 9/2009 Kawaguchi ..... 271/227

* cited by examiner

*Primary Examiner*—Patrick Mackey
*Assistant Examiner*—Prasad V Gokhale
(74) *Attorney, Agent, or Firm*—Patterson & Sheridan, LLP

(57) ABSTRACT

A technique is provided that can realize highly accurate skew correction without employing any particularly complicated device configuration. The quantity of skew of a sheet is determined in accordance with a detection result from a first pair of sensors. Driving of each of first rollers and second rollers is separately controlled to carry the sheet in such a manner as to reduce the quantity of skew determined in accordance with the detection result from the first pair of sensors. The quantity of skew of the sheet is determined in accordance with a detection result from a second pair of sensors. Driving of each of the first rollers and the second rollers is separately controlled to carry the sheet in such a manner as to reduce the quantity of skew determined in accordance with the detection result from the second pair of sensors.

17 Claims, 11 Drawing Sheets

SHEET CARRYING DEVICE AND SHEET CARRYING METHOD

BACKGROUND OF THE INVENTION

1. Field of the Invention

The present invention relates to a sheet carrying technique for carrying a sheet, and particularly to a technique of correcting a skew of a carried sheet.

2. Description of the Related Art

Conventionally, a technique of arraying two pairs of rollers are arranged in a direction that crosses a sheet carrying direction and controlling the sheet carrying speed of each of the two pairs of rollers to cancel a skew of a sheet detected by sensors is known.

In the conventional technique, in order to realize more accurate skew correction, there is known a mechanism that enables adjustment of the spacing between the pairs of rollers in a direction orthogonal to the sheet carrying direction in accordance with the width of the sheet to be carried, a mechanism in which multiple pairs of the above rollers are arranged in advance at positions corresponding to various sheet widths and are switched in accordance with the width of the sheet, and so on (see, for example, JP-A-2001-233506).

However, if higher accuracy in skew correction is to be realized by the above conventional technique, there is a problem that the configuration of the sheet carrying device becomes complicated.

SUMMARY OF THE INVENTION

It is an object of an embodiment of the invention to provide a technique that enables realization of highly accurate skew correction without employing a particularly complicated device configuration.

To solve the above problem, a sheet carrying device according to an aspect of the invention includes: first and second rollers arranged at different positions from each other in a direction orthogonal to a sheet carrying direction, each of which can be separately driven to rotate; a first pair of sensors including at least two sensors arranged in an upstream vicinity of the first and second rollers in the sheet carrying direction and arrayed in the direction orthogonal to the sheet carrying directions; a second pair of sensors including at least two sensors arranged in a downstream vicinity of the first and second rollers in the sheet carrying direction and arrayed in the direction orthogonal to the sheet carrying direction; a first skew determining unit configured to determine a quantity of skew of the sheet in accordance with a detection result from the first pair of sensors; a first control unit configured to separately control driving of each of the first and second rollers to carry the sheet in such a manner as to reduce the quantity of skew determined by the first skew determining unit; a second skew determining unit configured to determine a quantity of skew of the sheet in accordance with a detection result from the second pair of sensors; and a second control unit configured to separately control driving of each of the first and second rollers to carry the sheet in such a manner as to reduce the quantity of skew determined by the second skew determining unit.

A sheet carrying method according to another aspect of the invention is a sheet carrying method for a sheet carrying device including first and second rollers arranged at different positions from each other in a direction orthogonal to a sheet carrying direction, each of which can be separately driven to rotate, a first pair of sensors including at least two sensors arranged in an upstream vicinity of the first and second rollers in the sheet carrying direction and arrayed in the direction orthogonal to the sheet carrying directions, and a second pair of sensors including at least two sensors arranged in a downstream vicinity of the first and second rollers in the sheet carrying direction and arrayed in the direction orthogonal to the sheet carrying direction. The method includes: determining a quantity of skew of the sheet in accordance with a detection result from the first pair of sensors; separately controlling driving of each of the first and second rollers to carry the sheet in such a manner as to reduce the quantity of skew determined in accordance with the detection result from the first pair of sensors; determining a quantity of skew of the sheet in accordance with a detection result from the second pair of sensors; and separately controlling driving of each of the first and second rollers to carry the sheet in such a manner as to reduce the quantity of skew determined in accordance with the detection result from the second pair of sensors.

DESCRIPTION OF THE EMBODIMENTS

Hereinafter, embodiments of the invention will be described with reference to the drawings.

First Embodiment

Figure 1:
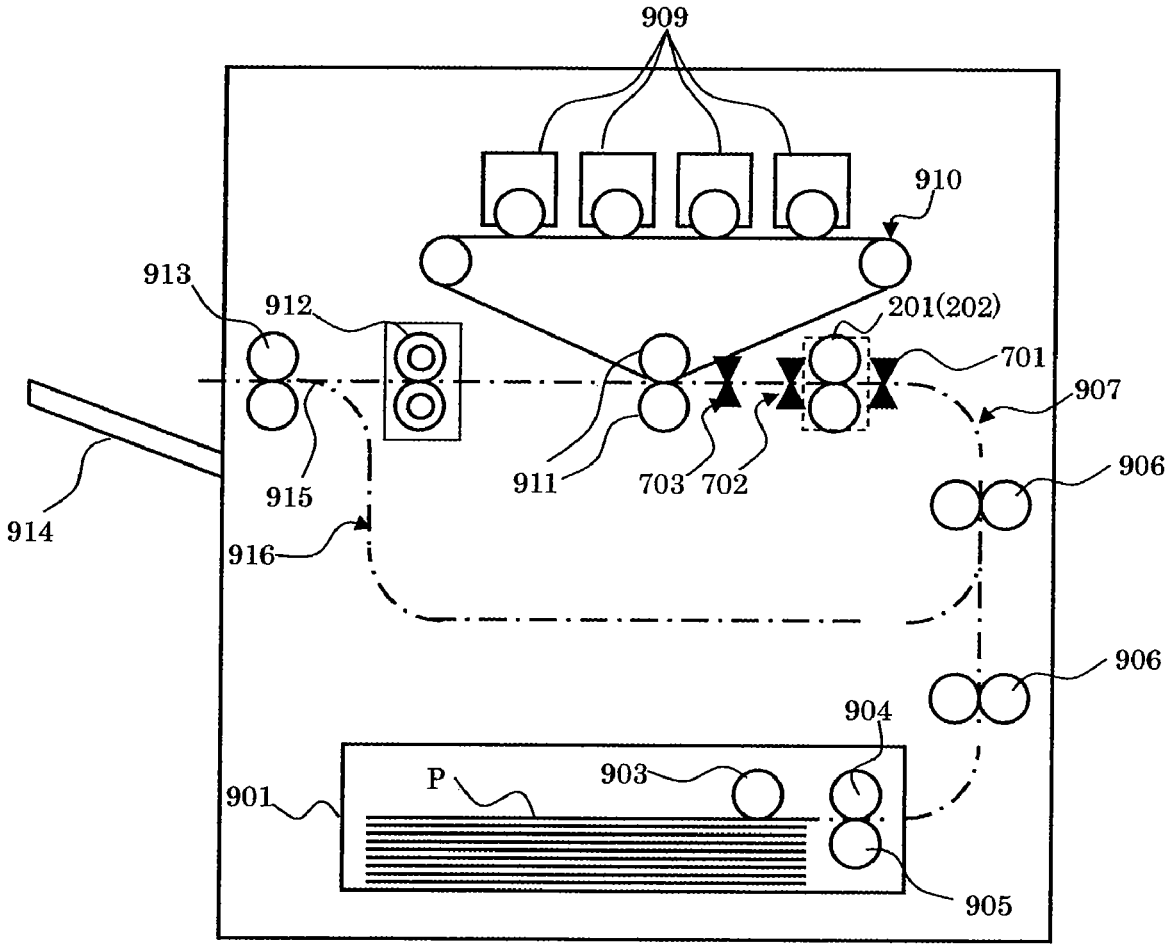
FIG. 1 is a schematic sectional view for explaining a sheet carrying device according to a first embodiment of the invention and an image forming apparatus having the sheet carrying device.

FIG. 1 is a schematic sectional view for explaining a sheet carrying device according to a first embodiment of the invention and an image forming apparatus having the sheet carrying device.

In FIG. 1, sheets P stacked on a paper feed tray 901 are sent out by a pickup roller 903, then separated one by one by a feed roller 904 and a reverse roller 905, and sent to a pair of carrying rollers 906.

The sheet P carried in a paper feed carrying path 907 has its skew corrected by registration rollers 201 and 202 as sheet carrying means and skew correction means.

The image forming apparatus in this example is a color image forming apparatus. The registration rollers 201 and 202 adjust the sheet carrying speed so that the sheet can be appropriately positioned at images formed on an intermediate transfer body 910 by four image forming units 909 (for example, corresponding to the four colors of yellow, magenta, cyan, and black). When the sheet P is carried to a predetermined transfer position, the sheet P is pressed to the intermediate transfer body 910 by transfer rollers 911. A developed image on the intermediate transfer body 910 is transferred onto the sheet P.

The developed image transferred onto the sheet P is thermally fixed by a fixing device 912. The sheet P to which the developed image has been thermally fixed is then discharged onto a paper discharge tray 914 by paper discharge rollers 913.

In the case of carrying out double-side printing, the sheet P with an image formed on its first side is returned to the paper feed carrying path 907 via a double-side carrying path 916 from a branching section 915 located downstream of the fixing device 912 in the sheet carrying direction. The sheet P has an image formed onto its second side and is discharged onto the paper discharge tray 914.

Figure 2:
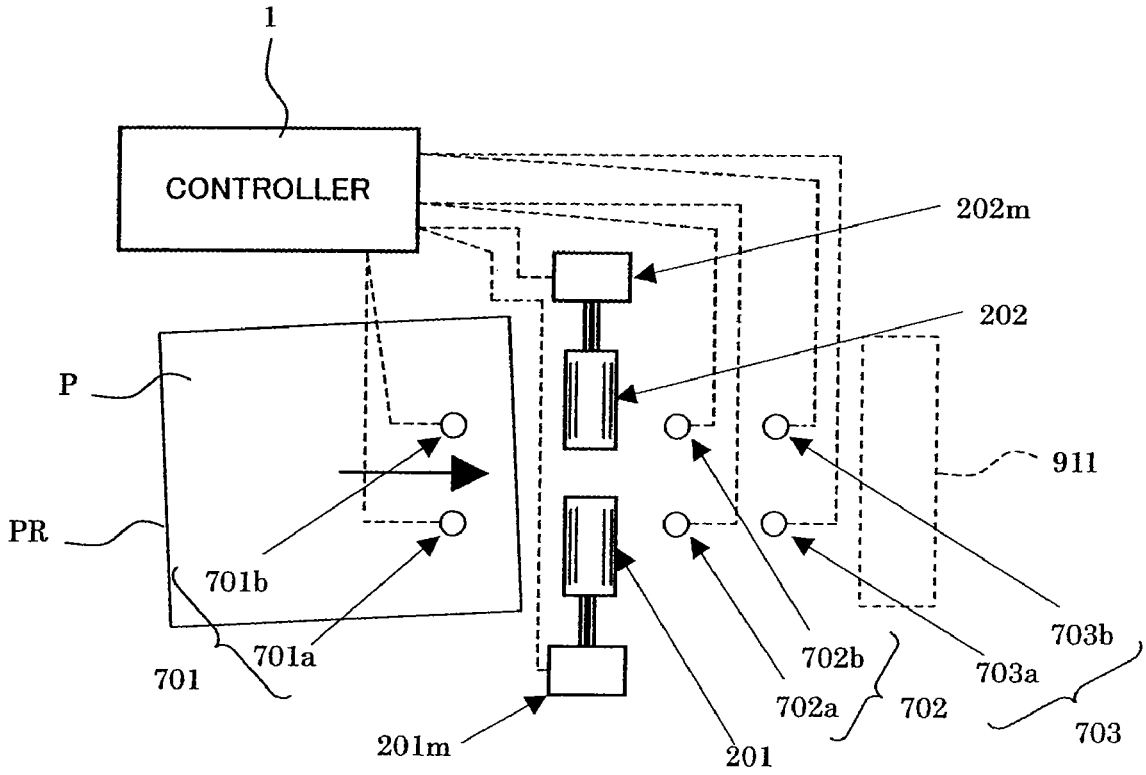
FIG. 2 is a view showing a schematic configuration of the vicinity of registration rollers in the sheet carrying device according to the first embodiment of the invention, as viewed from above.
Figure 3:
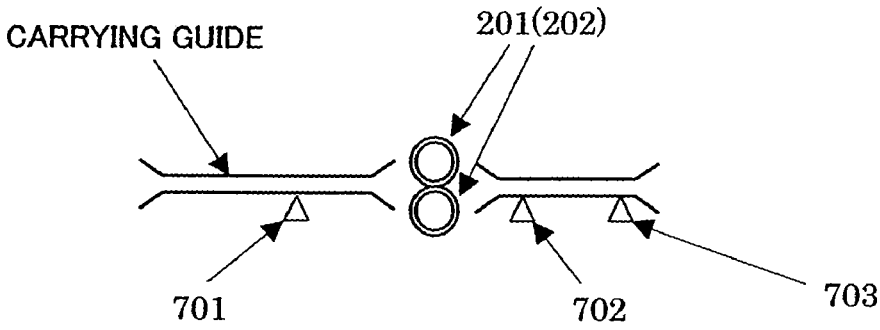
FIG. 3 is a view showing a schematic configuration of the vicinity of the registration rollers in the sheet carrying device according to the first embodiment of the invention, as viewed from the lateral side (the direction of the rotation axis of the registration rollers).

FIG. 2 is a view showing a schematic configuration of the vicinity of the registration rollers in the sheet carrying device according to the first embodiment of the invention, as viewed from above. FIG. 3 is a view showing a schematic configuration of the vicinity of the registration rollers in the sheet carrying device according to the first embodiment of the invention, as viewed from the lateral side (the direction of the rotation axis of the registration rollers).

As shown in FIG. 2, the registration rollers 201 (first rollers) and 202 (second rollers) are arranged at positions different from each other in a direction orthogonal to the sheet carrying direction (in this example, positions where the rollers can nip the vicinity of both sides of the carried sheet) The registration rollers 201 and 202 can be separately driven to rotate by motors 201*m* and 202*m*. The registration rollers 201 and 202 in this example are configured to be driven to rotate about the same rotation axis orthogonal to the sheet carrying direction. As the registration rollers 201 and 202 are arranged in the vicinity of both sides of the carried sheet in this manner, highly accurate adjustment of angle can be made in the case of performing skew correction with these rollers.

In the upstream vicinity of the registration rollers 201 (first rollers) and 202 (second rollers) in the sheet carrying direction in this embodiment, a first pair of sensors 701 is provided which includes at least two sensors (a sensor 701*a* and a sensor 701*b*) (see FIG. 2) arranged in the direction orthogonal to the sheet carrying direction.

In the downstream vicinity of the registration rollers 201 and 202, a second pair of sensors 702 is provided which includes at least two sensors (a sensor 702*a* and a sensor 702*b*) arranged in the direction orthogonal to the sheet carrying direction.

Moreover, in the downstream vicinity of the second pair of sensors 702 in the sheet carrying direction, a third pair of sensors 703 is provided which includes at least two sensors (a sensor 703*a* and a sensor 703*b*) arranged in the direction orthogonal to the sheet carrying direction.

The second pair of sensors 702 and the third pair of sensors 703 in this case are arranged upstream from the transfer rollers 911 in the sheet carrying direction. The distance from the nips of the registration rollers 201 and 202 to the third pair of sensors 703 in the sheet carrying direction is set to be shorter than the length of a sheet to be carried in the sheet carrying direction. This enables the third pair of sensors 703 to detect a skew of the sheet in the state of being nipped by the registration rollers 201 and 202.

The first pair of sensors 701, the second pair of sensors 702 and the third pair of sensor 703 include, for example, optical reflection sensors. These sensors are arranged with a predetermined spacing so that they can detect the forward edge (downstream edge part PF in the sheet carrying direction) or the rear edge (upstream edge part PR in the sheet carrying direction) that is outer than the center position of the sheet in the direction orthogonal to the sheet carrying direction (for example, at positions where they can detect the vicinity of both sides of the minimum-width sheet that can be carried).

The registration rollers 201 and 202 are drive-controlled by a controller 1 in accordance with the detection results from the first pair of sensor 701, the second pair of sensor 702 and the third pair of sensor 703.

Figure 4:
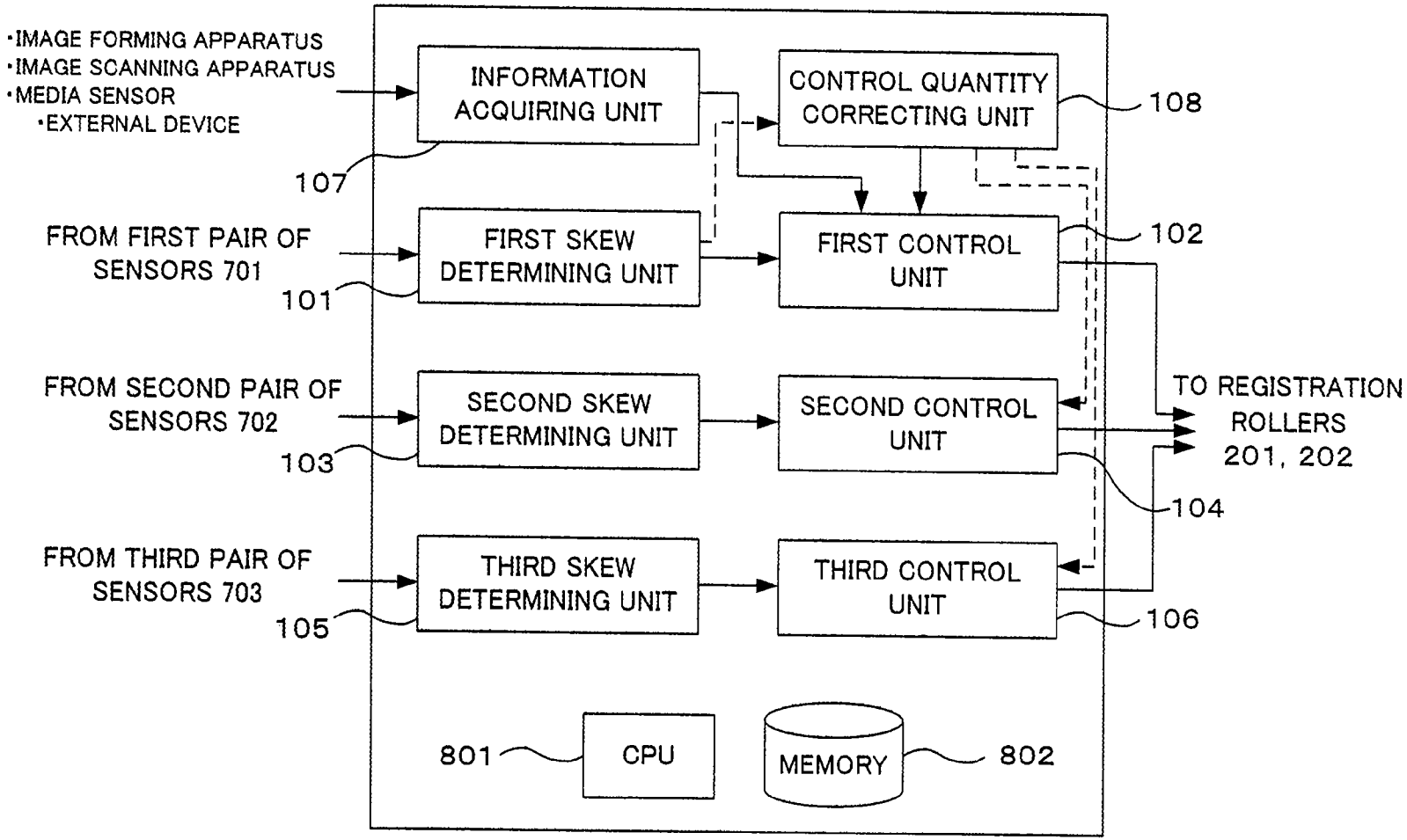
FIG. 4 is a functional block diagram for explaining the sheet carrying device according to the embodiment and the image forming apparatus having the sheet carrying device.

FIG. 4 is a functional block diagram for explaining the sheet carrying device according to this embodiment and the image forming apparatus having the sheet carrying device.

The sheet carrying device according to this embodiment has a first skew determining unit 101, a first control unit 102, a second skew determining unit 103, a second control unit 104, a third skew determining unit 105, a third control unit 106, an information acquiring unit 107, a control quantity correcting unit 108, a CPU 801 and a memory 802, in addition to the registration rollers 201, the registration rollers 202, the first pair of sensors 701, the second pair of sensors 702 and the third pair of sensors 703.

The first skew determining unit 101 determines the quantity of skew of the carried sheet in accordance with the result of detection of the forward edge PF or the rear edge PR of the sheet by the first pair of sensors 701.

The first control unit 102 separately controls the driving of each of the registration rollers 201 and 202 to carry the sheet in such a manner as to reduce the quantity of skew determined by the first skew determining unit 101. The first control unit 102 varies the rotation speed of the registration rollers 201 and 202 from each other in order to correct the skew of the sheet P when the sheet with its downstream edge part PF in the sheet carrying direction detected by the first pair of sensors 701 enters the nips of the registration rollers 201 and 202.

When the quantity of skew determined by the first skew determining unit 101 is equal to or larger than a predetermined value, the first control unit 102 in this example can cause the registration rollers 201 and 202 to correct the skew by, for example, reducing the sheet carrying speed of the registration rollers 201 and 202, compared to the case where the quantity of skew determined by the first skew determining unit 101 is less than the predetermined value.

Alternatively, when the quantity of skew determined by the first skew determining unit 101 is equal to or larger than the predetermined value, the first control unit 102 can cause the registration rollers 201 and 202 to stop carrying the sheet.

Moreover, in accordance with information acquired by the information acquiring unit 107 (which will be described later), the first control unit 102 can switch modes between a first mode in which when the quantity of skew determined by the first skew determining unit 101 is equal to or larger than the predetermined value, the first control unit 102 causes the registration rollers 201 and 202 to correct the skew by reducing the sheet carrying speed of the registration rollers 201 and 202, compared to the case where the quantity of skew determined by the first skew determining unit 101 is less than the predetermined value, and a second mode in which when the quantity of skew determined by the first skew determining unit 101 is equal to or larger than the predetermined value, the first control unit 102 causes the registration rollers 201 and 202 to stop carrying the sheet, then correct the skew, and resume carrying the sheet.

The second skew determining unit 103 determines the quantity of skew of the sheet in accordance with the detection result from the second pair of sensors 702.

The second control unit 104 separately controls the driving of each of the registration rollers 201 and 202 to carry the sheet in such a manner as to reduce the quantity of skew determined by the second skew determining unit 103.

The third skew determining unit 105 determines the quantity of skew of the sheet in accordance with the detection result from the third pair of sensors 703.

The third control unit 106 separately controls the driving of each of the registration rollers 201 and 202 in such a manner as to reduce the quantity of skew determined by the third skew determining unit 105.

The information acquiring unit 107 acquires information about the type of the sheet to be carried in the sheet carrying device, from a media sensor or the like provided in the image forming apparatus or the sheet carrying device. Specifically, the "information about the type of the sheet" refers to surface roughness, reflectance and so on as parameters for smoothness of the sheet surface, and elements that can influence the adjustment of the angle of the sheet when the registration rollers perform skew correction, such as the thickness and type of paper of the sheet. The timing of acquiring the information by the information acquiring unit 107 may be any timing before the execution of skew correction control by the first control unit 102.

The control quantity correcting unit 108 corrects the quantity of control at the time of skew correction control by the first control unit 102 for a sheet that is carried after the sheet in question, in accordance with the difference between the quantity of skew determined by the first skew determining unit 101 on the basis of the detection result from the first pair of sensors 701 with respect to the downstream edge part PF in the sheet carrying direction of the sheet to be carried, and the quantity of skew determined by the first skew determining unit 101 on the basis of the detection result from the first pair of sensors 701 with respect to the upstream edge part PR in the sheet carrying direction of the sheet carried by the registration rollers 201 and 202 in the state where skew correction control is not performed by the first control unit 102.

The CPU 801 is responsible for carrying out various processing in the sheet carrying device and is also responsible for realizing various functions by executing programs stored in the memory 802. The memory 802 includes, for example, a ROM, RAM and so on, and is responsible for storing various information and programs used in the sheet carrying device.

Next, the sheet carrying operation in the sheet carrying device according to this embodiment will be described in detail.

The sheet P carried from upstream of the registration rollers 201 and 202 has its downstream edge part PF in the sheet carrying direction detected by the first pair of sensors 701.

When the quantity of skew determined by the first skew determining unit 101 is small than a predetermined value, the first control unit 102 causes the sheet P to enter the roller nips in the state where the registration rollers 201 and 202 are rotating, and thus causes the registration rollers 201 and 202 to correct the skew. The downstream edge part PF of the sheet P, which has its skew corrected by the registration rollers 201 and 202, is detected by the subsequent second pair of sensors 702.

The second control unit 104 controls the driving of the registration rollers 201 and 202 in such a manner that the registration rollers 201 and 202 have different rotation speeds from each other in order to reduce the quantity of skew determined by the second skew determining unit 103 (the quantity of skew that remains even after the skew correction by the first control unit).

The third control unit 106 controls the driving of the registration rollers 201 and 202 in such a manner as to further reduce the quantity of skew that remains even after the skew correction by the second control unit 104 (the quantity of skew determined by the third skew determining unit 105).

On the other hand, when the quantity of skew determined by the first skew determining unit 102 is larger than the predetermined value, the registration rollers 201 and 202 are put into a stop state or low-speed state and the sheet P is inserted into the roller nips. After the quantity of skew is roughly reduced, skew correction is carried out using the difference in rotation speed between the registration rollers 201 and 202.

In the case of enabling both a narrow sheet and a broad sheet to be carried, it is necessary to provide the nips on each pair of carrying rollers in a broad range in the direction of the rotation axis. In this case, at the time of carrying abroad sheet, the quantity of sliding of the sheet in the roller nips becomes large and there may be a problem that skew correction control for a large quantity of skew is unstable.

Thus, the quantity of skew is reduced to a certain degree by a method such as detecting the quantity of skew of the sheet before the sheet enters the nips of the registration rollers 201 and 202 and then abutting the forward edge of the sheet to the nips of the stopped registration rollers if the detected quantity of skew is over a predetermined quantity of skew. After that, the quantity of skew that has not been eliminated is reduced by using the difference in rotation speed between the registration rollers 201 and 202.

Figure 5:
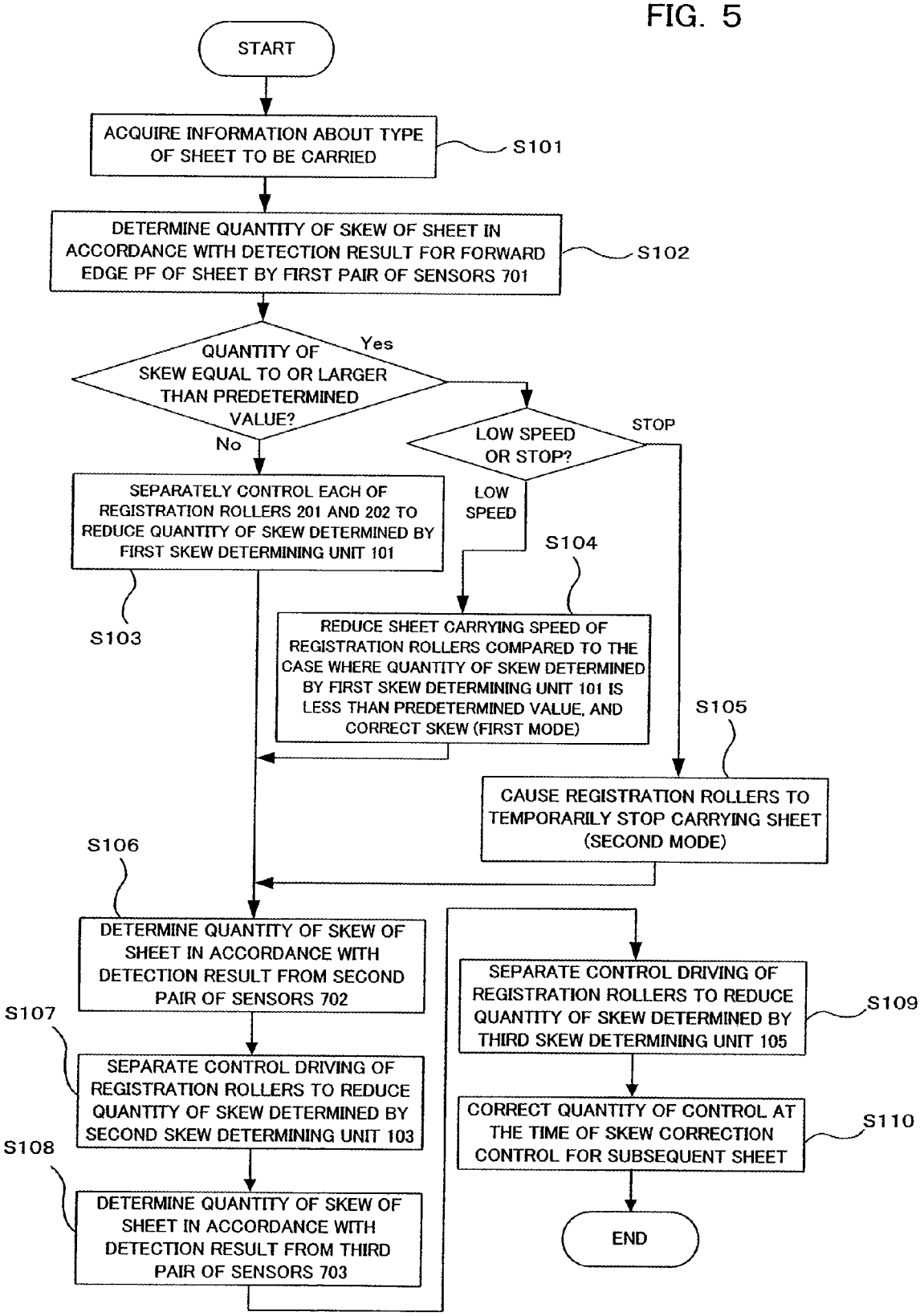
FIG. 5 is a flowchart for explaining a flow of processing in the sheet carrying device according to the embodiment.

FIG. 5 is a flowchart for explaining a flow of processing in the sheet carrying device according to this embodiment.

First, the information acquiring unit 107 acquires information about the type of a sheet to be carried in the sheet carrying device (S101).

The first skew determining unit 101 determines the quantity of skew of the carried sheet in accordance with the result of detection of the forward edge PF of the sheet by the first pair of sensors 701 (S102).

Next, the first control unit 102 separately controls the driving of each of the registration rollers 201 and 202 to carry the sheet in such a manner as to reduce the quantity of skew determined by the first skew determining unit 101 (S103).

When the quantity of skew determined by the first skew determining unit 101 is equal to or larger than a predetermined value, the sheet carrying speed of the registration rollers 201 and 202 is reduced compared to the case where the quantity of skew determined by the first skew determining unit 101 is less than the predetermined value, and the registration rollers 201 and 202 are thus caused to correct the skew (first mode) (S104). Alternatively, the registration rollers 201 and 202 are caused to temporarily stop carrying the sheet (second mode) (S105).

Here, which of the "first mode" and "second mode" the first control unit 102 uses for skew correction, is set in advance by the user or by default. Alternatively, which mode should be selected may be decided in accordance with the information acquired by the information acquiring unit 107.

Next, the second skew determining unit 103 determines the quantity of skew of the sheet in accordance with the detection result from the second pair of sensors 702 (S106).

The second control unit 104 separately controls the driving of each of the registration rollers 201 and 202 to carry the sheet in such a manner as to reduce the quantity of skew determined by the second skew determining unit 103 (S107).

The third skew determining unit 105 determines the quantity of skew of the sheet in accordance with the detection result from the third pair of sensors 703 (S108).

The third control unit 106 separately controls the driving of each of the registration rollers 201 and 202 in such a manner as to reduce the quantity of skew determined by the third skew determining unit 105 (S109).

The control quantity correcting unit 108 corrects the quantity of control at the time of skew correction control by the first control unit 102 and the second control unit 104 for a sheet that is carried after the sheet in question, in accordance with the difference between the quantity of skew determined by the first skew determining unit 101 on the basis of the detection result from the first pair of sensors 701 with respect to the downstream edge part PF in the sheet carrying direction of the sheet to be carried, and the quantity of skew determined by the first skew determining unit 101 on the basis of the detection result from the first pair of sensors 701 with respect to the upstream edge part PR in the sheet carrying direction of the sheet carried by the registration rollers 201 and 202 in the state where skew correction control is not performed by the first control unit 102 (S110).

As described above, according to this embodiment, it is possible to carry out highly accurate skew correction in stages based on the detection result from the third pair of sensors by reviewing the result of skew correction based on the detection result from the second pair of sensors. Moreover, skews of sheets having various sizes can be corrected highly accurately with the simple mechanism.

Second Embodiment

Next, a second embodiment of the invention will be described.

The second embodiment of the invention is a modification of the above first embodiment. Hereinafter, in this embodiment, the parts having similar functions as those already described in the first embodiment are denoted by the same reference numerals and will not be described further in detail.

Figure 6:
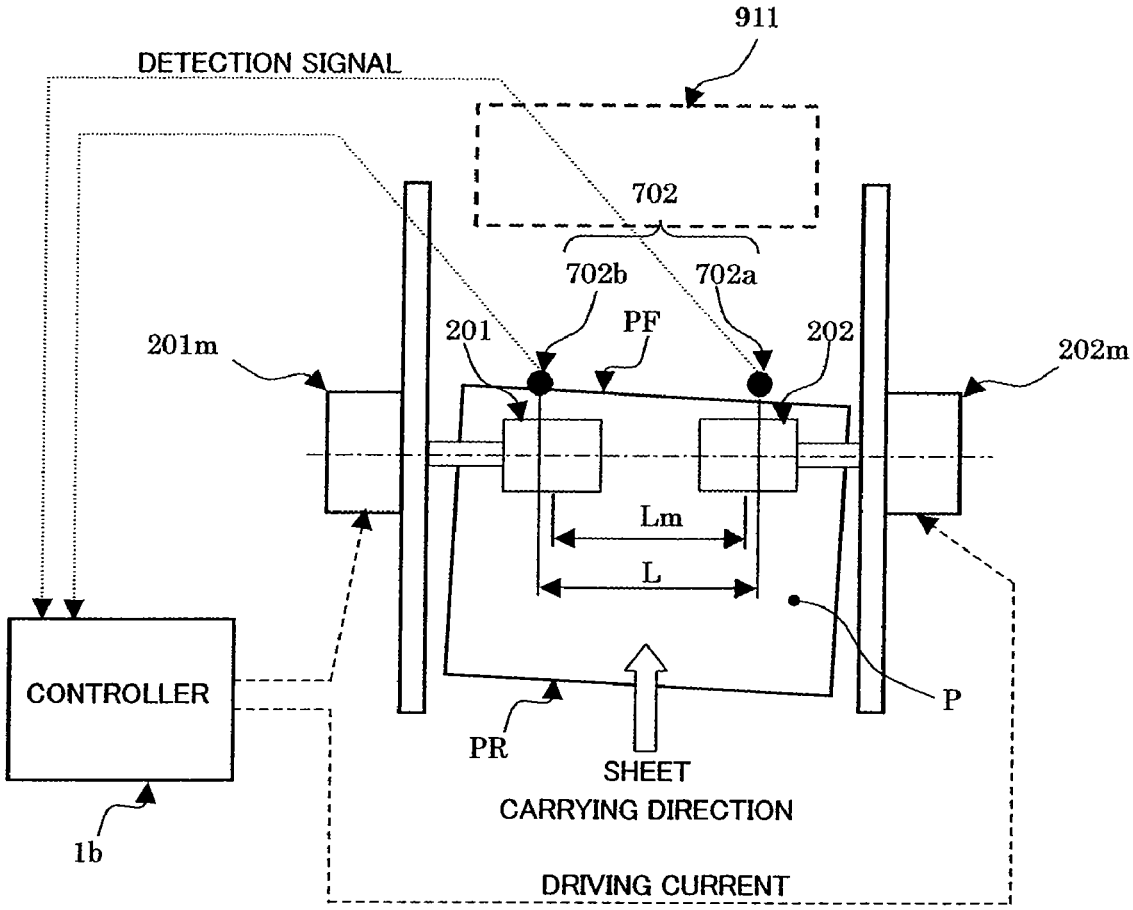
FIG. 6 is a view showing a schematic configuration of the vicinity of registration rollers in a sheet carrying device according to a second embodiment of the invention, as viewed from above.
Figure 7:
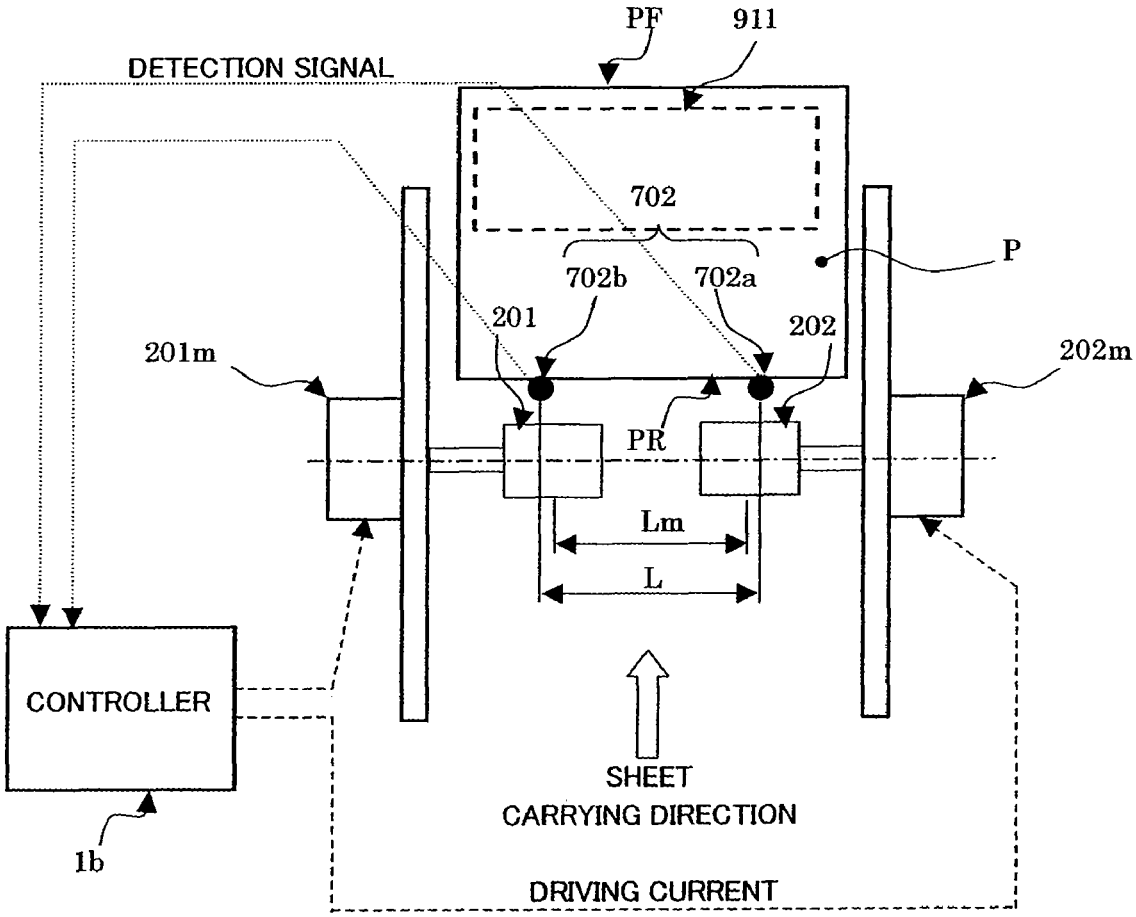
FIG. 7 is a view showing a schematic configuration of the vicinity of the registration rollers in the sheet carrying device according to the second embodiment of the invention, as viewed from above.

FIG. 6 and FIG. 7 are views showing a schematic configuration of the vicinity of registration rollers in a sheet carrying device according to the second embodiment of the invention, as viewed from above. In the sheet carrying device according to this embodiment, only a pair of sensors for detecting a skew of a sheet is provided, unlike the above first embodiment. Here, what is expressed as the "second pair of sensors" in the first embodiment is now simply referred to as a "pair of sensors".

A controller 1*b* in the sheet carrying device according to this embodiment has the functions equivalent to the second skew determining unit 103, the second control unit 104, the information acquiring unit 107, the control quantity correcting unit 108, the CPU 801 and the memory 802 described in the first embodiment.

FIG. 6 is a view showing a state where the forward edge PF of the carried sheet passes the pair of sensors 702 (sensors 702*a* and 702*b*). FIG. 7 is a view showing a state where the rear edge PR of the carried sheet passes the sensors 702*a* and 702*b*.

From the quantity of skew determined on the basis of the detection result from the sensors 702*a* and 702*b*, the controller 1*b* calculates the necessary driving speed of each of the motors 202*m* and 201*m* for the registration rollers 201 and 202 to reduce the quantity of skew, and controls the registration rollers 201 and 202.

In FIG. 6, when the forward edge PF of the sheet passes the sensor 702*a* or 702*b*, its sensor signal is switched from OFF to ON. It is now assumed that the sensors 702*a* and 702*b* are arranged on a line orthogonal to the sheet carrying direction.

If the sheet P is skewed as shown in FIG. 6, the sensor 702*b* is turned ON first by the side of the forward edge PF of the sheet that is moving forward faster, and the sensor 702*a* is switched ON later by the side that is delayed.

If the time difference between the time when the forward edge PF of the sheet is detected by the sensor 702*a* and the time when the forward edge PF of the sheet is detected by the sensor 702*b* is Δt, the average carrying speed of the registration rollers 201 and 202 is V, and the distance between the sensors 702*a* and 702*b* is L, the estimate value of the quantity of skew θ (angle) can be expressed by the following equation.

$$\theta=(V\Delta t)/L[\text{rad}] \tag{1}$$

To correct the skew of the sheet by the registration rollers 201 and 202 until the sheet takes the normal attitude, control can be performed in such a manner that the difference in peripheral speed between the rollers (ΔV=Va−Vb) satisfies the following.

$$\theta+\int\beta(\Delta V/Lm)dt=0 \tag{2}$$

(In this equation, the integral range is from the skew correction start time t1 to the skew correction end time t2.)

Here, Lm represents the distance between the center positions in the direction of width of the roller nips by the registration rollers 201 and 202. β is a correction coefficient for correcting the effective distance between the two rollers nips. Its value is variable depending on the type of paper, thickness of paper or size of paper. Here, the simplest case where V is constant (uniform) is described as an example. Then, the equation (2) can be expressed as follows.

$$\theta+(\beta\times((Va-Vb)/Lm)\times(t2-t1))=0 \tag{3}$$

(In this equation, the integral range is from the skew correction start time t1 to the skew correction end time t2.) Here, the following relation holds.

$$V=(Va+Vb)/2 \tag{4}$$

Therefore, if the roller speed is controlled to satisfy $$Va=V-((Lm\times\theta)/2\times\beta\times(t2-t1)) \tag{5}$$

$$Vb=V+((Lm\times\theta)/2\times\beta\times(t2-t1)) \tag{6},$$

the skew is corrected.

Next, the skew at the rear edge PR of the sheet P that is skew-corrected by the registration rollers 201 and 202 as described above and is sent out to the transfer position (or the original scanning position in the image scanning apparatus) is detected by using the sensors 702*a* and 702*b* again.

Although there are some exceptions, the sheet to be carried in the sheet carrying device is rectangular in most cases. In such cases, the quantity of skew at the forward edge PR of the sheet and the quantity of skew at the rear edge PR of the sheet are coincident with each other. The roller characteristics may change as they are used for a long time, and with the above-described skew correction control alone, the skew correction accuracy may deteriorate. For example, the optimum correction coefficient β may change with time.

In such cases, as the rear edge PR of the skew-corrected sheet P is detected by the pair of sensors 702, a skew error after the skew correction can be recognized, and appropriate correction can be made at the time of carrying the subsequent sheet (similarly to the function of the control quantity correcting unit 108 in the first embodiment).

Thus, the deterioration with time of the skew correction accuracy due to changes in the carrying characteristics and so on of the registration rollers can be prevented. Moreover, in this embodiment, the pair of sensors used for detecting the forward edge of the sheet and correcting its skew and the pair of sensors for checking whether the skew has been appropriately corrected or not are the same. Therefore, a space for additional arrangement of another pair of sensors need not be secured and it can contribute to space saving and reduction in cost.

Third Embodiment

Next, a third embodiment of the invention will be described.

The third embodiment of the invention is a modification of the above-described second embodiment. Hereinafter, in this embodiment, the parts having the similar functions to those already described in the second embodiment are denoted by the same reference numerals and will not be described further in detail.

Figure 8:
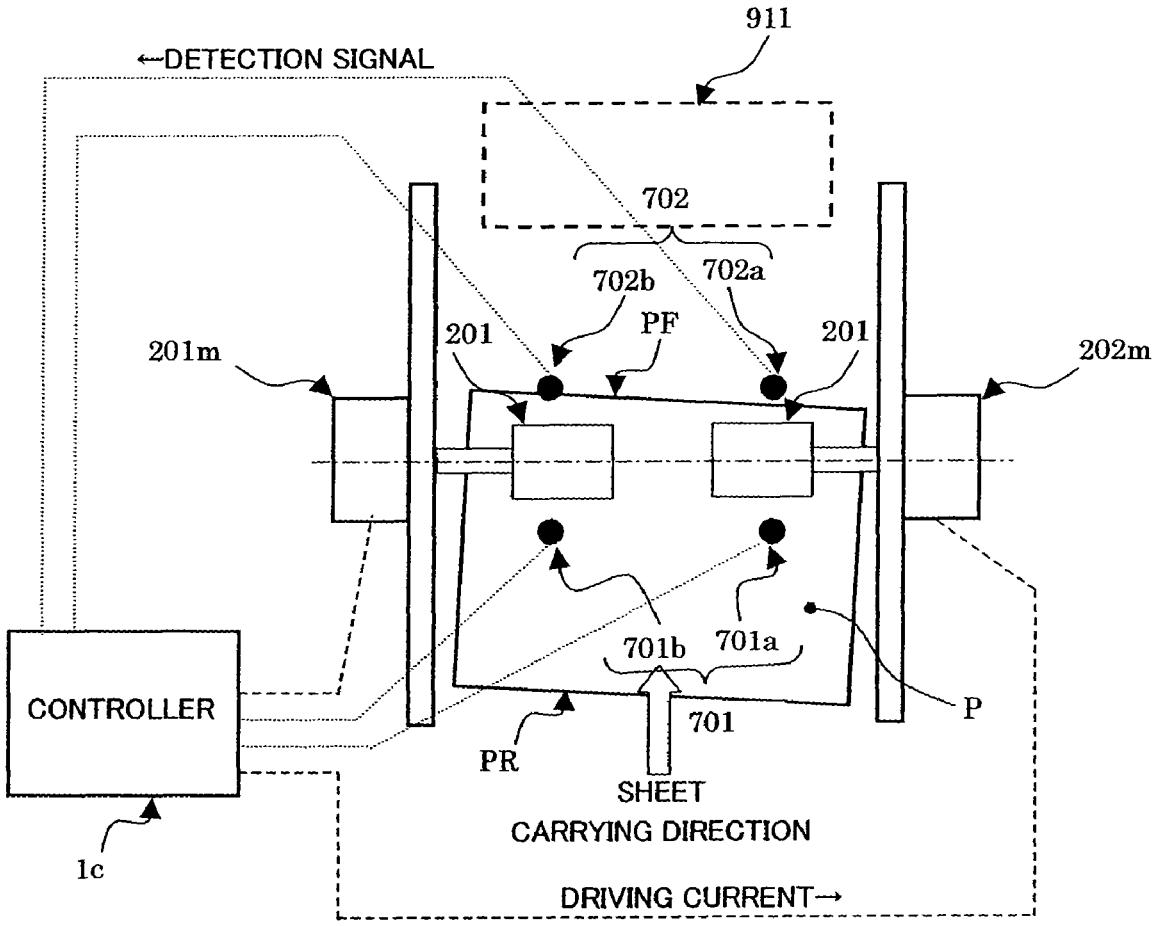
FIG. 8 is a view showing a schematic configuration of the vicinity of registration rollers in a sheet carrying device according to a third embodiment of the invention, as viewed from above.
Figure 9:
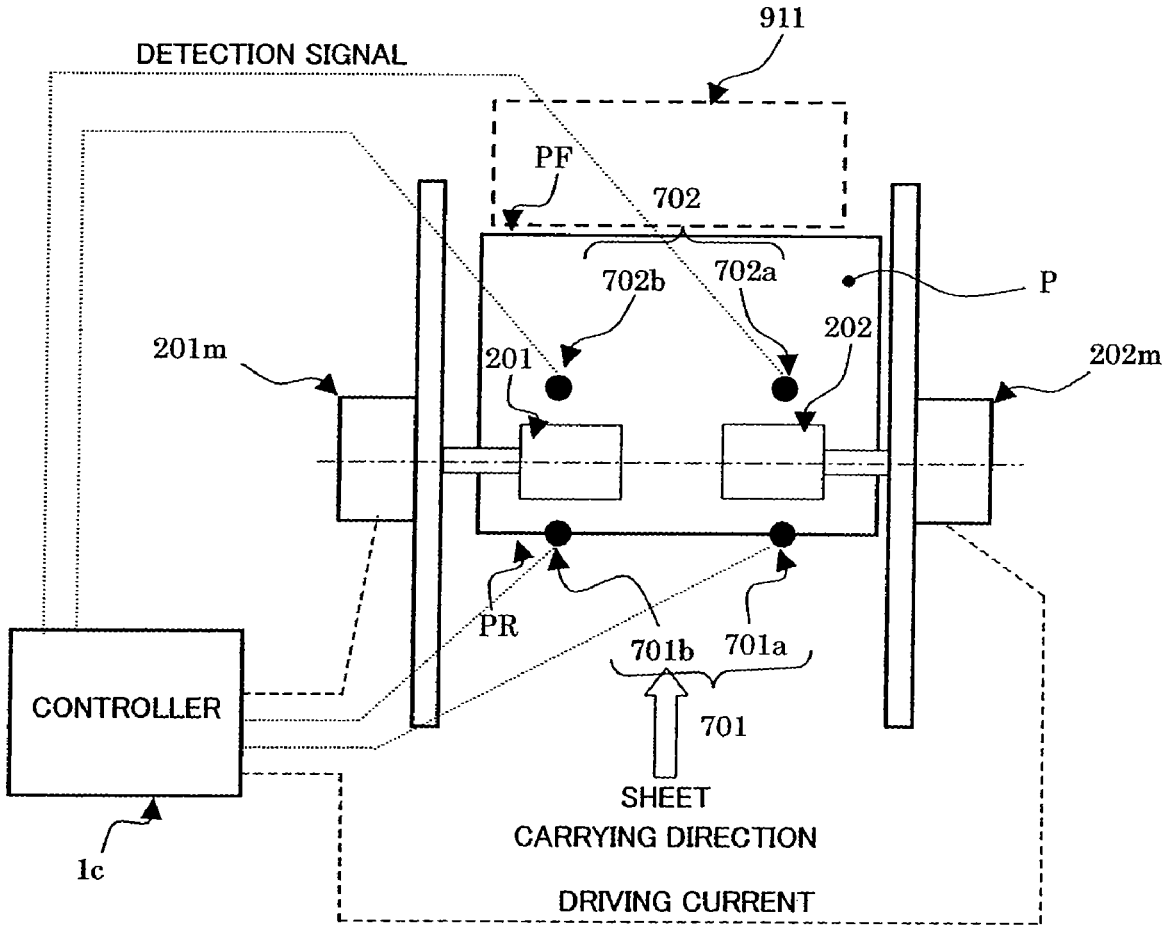
FIG. 9 is a view showing a schematic configuration of the vicinity of the registration rollers in the sheet carrying device according to the third embodiment of the invention, as viewed from above.

FIG. 8 and FIG. 9 are views showing a schematic configuration of the vicinity of registration rollers in a sheet carrying device according to the third embodiment of the invention, as viewed from above. In the sheet carrying device according to this embodiment, another pair of sensors 701*a* and 701*b* for detecting a skew of a sheet is provided in addition to the configuration of the above second embodiment. Here, what are expressed as the "first pair of sensors" and "second pair of sensors" are simply referred to as "pair of sensors".

A controller 1*c* in the sheet carrying device according to this embodiment has the functions equivalent to the first skew determining unit 101, the first control unit 102, the second skew determining unit 103, the second control unit 104, the information acquiring unit 107, the control quantity correcting unit 108, the CPU 801 and the memory 802 described in the first embodiment.

FIG. 8 is a view showing a state where the forward edge PF of the carried sheet passes the pair of sensors 702 (sensors 702*a* and 702*b*). FIG. 9 is a view showing a state where the rear edge PR of the carried sheet passes the pair of sensors 701 (sensors 701*a* and 701*b*).

From the quantity of skew determined on the basis of the detection result from the pair of sensors 701 and the pair of sensors 702, the controller 1*c* calculates the necessary driving speed of each of the motors 202*m* and 201*m* for the registration rollers 201 and 202 to reduce the quantity of skew, and controls the registration rollers 201 and 202.

In the above second embodiment, the same pair of sensors 702 for the detection of the forward edge PF of the sheet is used for the detection of the rear edge PR of the sheet. However, in the third embodiment, the pair of sensors 701 provided in the upstream vicinity of the registration rollers 201 and 202 is used for the rear edge PR of the sheet. Since the sheet carrying device usually has sensors for detecting a so-called paper jam provided in the upstream vicinity of the registration rollers 201 and 202, these jam detecting sensors can also serve as the pair of sensors 701.

In this manner, as the rear edge PR of the sheet P that is skew-corrected by the registration rollers 201 and 202 is detected by the pair of sensors 701, a skew error after the skew correction can be recognized and appropriate correction can be made at the time of carrying the subsequent sheet.

With the configuration according to the third embodiment, since the vicinity of the rear edge PR of the sheet is nipped by the registration rollers 201 and 202 at the time of detecting the skew of the rear edge PR of the sheet, floating of the read edge of the sheet can be restrained and more stable skew detection can be realized.

According to the second embodiment and the third embodiment, the forward edge PF of the sheet is detected to correct the skew of the sheet P. Whether the skew has been corrected or not is determined at the rear edge PR of the sheet. If there is a remaining quantity of skew that has not been corrected, the quantity of skew correction control is corrected at the time of carrying the subsequent or next sheet. Thus, changes in carrying characteristics with time are compensated for.

By the way, if the quantity of skew at the time of detecting the forward edge PF of the sheet is 0 (zero), no skew correction control is performed. However, even in such cases, the quantity of skew at the rear edge PR of the sheet may be detected. If the sheet is rectangular, this means that the starting point of skew control in the registration rollers 201 and 202 as skew correction means is deviated.

Specifically, it may be the case where the outer diameters of the registration rollers 201 and 202 are varied because of changes with time such as wear. Even if the rotation speeds of the motors 201*m* and 202*m* are made equal, when the registration rollers 201 and 202 have different outer diameters from each other, the sheet carrying speed differs between the registration rollers 201 and 202.

Thus, in this embodiment, in order to solve this problem, the sheet is carried in the state where skew correction is not carried out by the registration rollers 201 and 202 (in the state where the sheet carrying speeds of these rollers are equal), and if the quantity of skew at the forward edge PF of the sheet differs from the quantity of skew at the rear edge PR of the sheet, it is then assumed that the speed is different between the registration rollers 201 and 202, and the registration rollers are adjusted to have the same speed. For example, the driving speed is lowered for the roller pair that tends to move faster, and the driving speed is raised for the roller pair that tends to be delayed. Thus, it is possible to adjust the starting point in the control of the sheet carrying speed of the registration rollers 201 and 202.

According to this embodiment, compared to the case where the section where skew correction is performed is divided into two or more in the carrying direction in order to perform control, each skew correction section can be made longer and the generation of creases and so on due to large skew correction within a short section can be restrained.

Fourth Embodiment

Next, a fourth embodiment of the invention will be described.

The fourth embodiment of the invention is a modification of each of the above-described embodiments. Hereinafter, in this embodiment, the parts having the similar functions to those already described in the above embodiments are denoted by the same reference numerals and will not be described further in detail.

Figure 10:
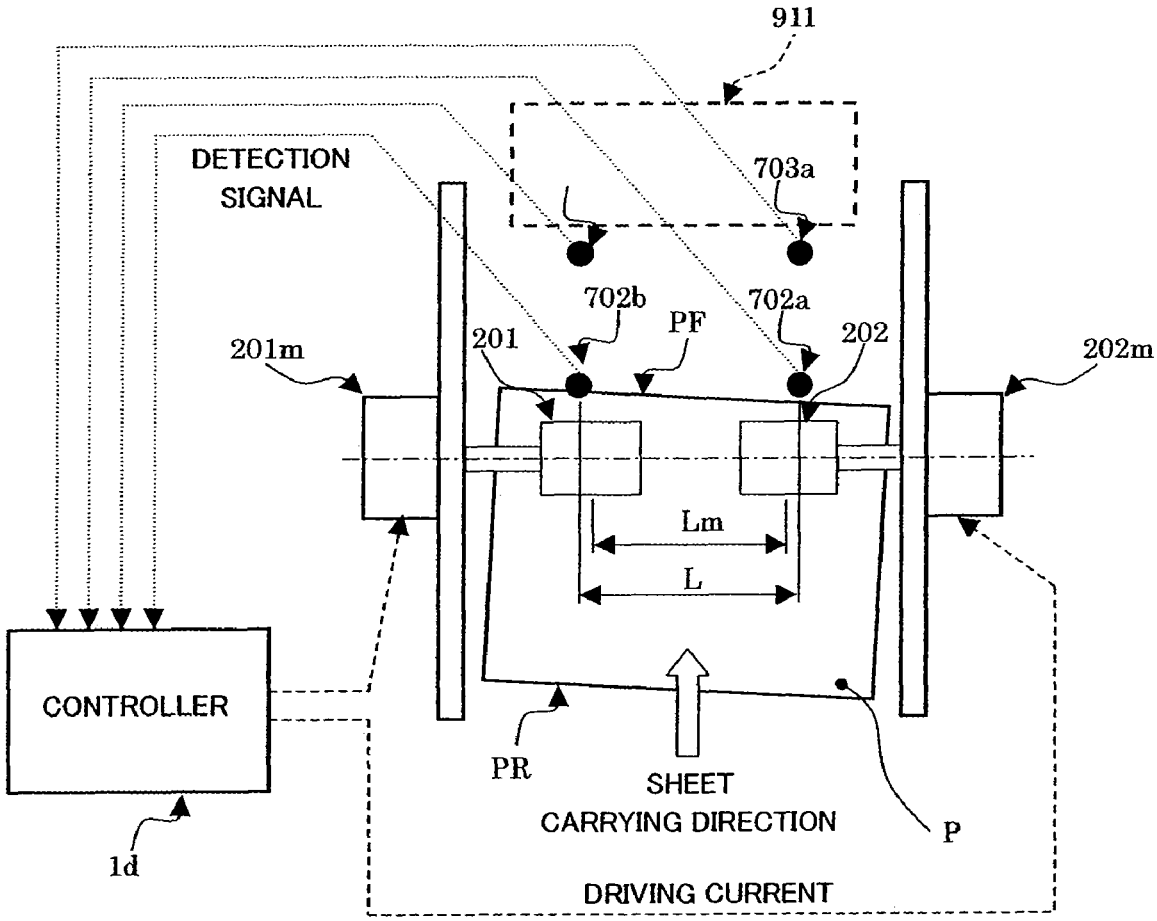
FIG. 10 is a view showing a schematic configuration of the vicinity of registration rollers in a sheet carrying device according to a fourth embodiment of the invention, as viewed from above.
Figure 11:
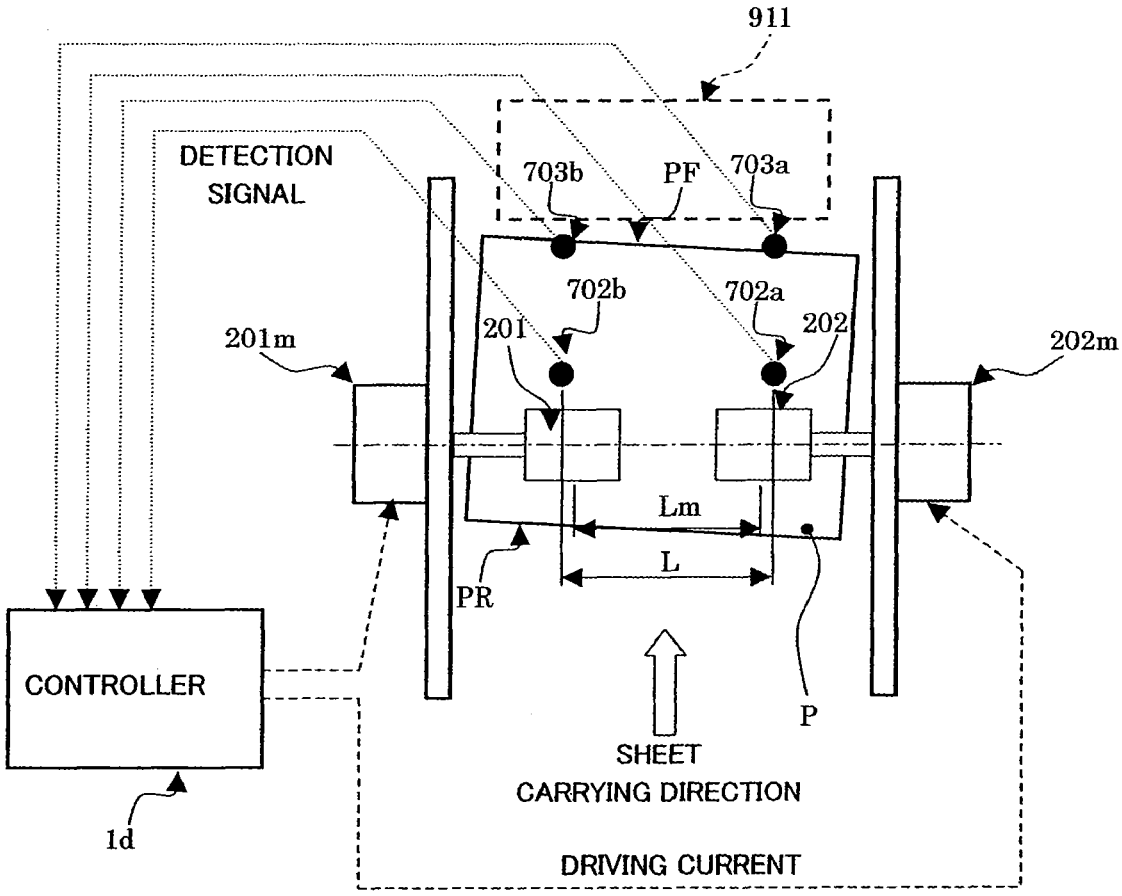
FIG. 11 is a view showing a schematic configuration of the vicinity of the registration rollers in the sheet carrying device according to the fourth embodiment of the invention, as viewed from above.

FIG. 10 and FIG. 11 are views showing a schematic configuration of the vicinity of registration rollers in a sheet carrying device according to the fourth embodiment, as viewed from above. The sheet carrying device according to this embodiment uses the pair of sensors 702 and the pair of sensors 703 for detecting a skew of a sheet. Here, what are expressed as the "second pair of sensors" and "third pair of sensors" are simply referred to as "pair of sensors".

A controller 1*d* in the sheet carrying device according to this embodiment has the functions equivalent to the second skew determining unit 103, the second control unit 104, the third skew determining unit 105, the third control unit 106, the information acquiring unit 107, the control quantity correcting unit 108, the CPU 801 and the memory 802 described in the first embodiment.

FIG. 10 is a view showing a state where the forward edge PF of the carried sheet passes the pair of sensors 702 (sensors 702*a* and 702*b*). FIG. 11 is a view showing a state where the forward edge PF of the carried sheet passes the pair of sensors 703 (sensors 703*a* and 703*b*).

As shown in FIG. 10, the skew correction state (quantity of skew) of the forward edge PF of the sheet P on which skew correction control is performed by the registration rollers 201 and 202 is detected by using the pair of sensors 703 arranged upstream of the transfer rollers 911 in the carrying direction.

However, in this embodiment, the quantity of skew of the sheet P which has been skew-corrected in accordance with the detection result from the pair of sensors 702 will not be re-corrected in accordance with the detection result from the pair of sensors 703. This is because the distance between the registration rollers 201 and 202 and the transfer rollers 911 usually cannot be made sufficiently long in view of the recent demand for miniaturization of the device. If skew correction is made again in such a short section, the quantity of skew correction control in the first stage becomes large in the case where the quantity of skew of the sheet P is large. This may cause generation of creases on the sheet.

Also, it is unknown whether the result of skew correction in the second stage is good or bad. These are the reasons for not carrying out re-correction based on the detection result from the pair of sensors 703 in this embodiment.

However, as the sheet carrying device is used for a long time, the sheet carrying characteristics and so on of the registration rollers 201 and 202 may change because of wear and so on, and correction accuracy may be deteriorated. For example, the optimum correction coefficient β may change with time.

Thus, the forward edge PF of the sheet is detected by the pair of sensors 703 and the remaining quantity of skew after the skew correction is recognized. The quantity of skew correction control is corrected at the time of carrying sheet that follows or at the time of carrying a sheet on another occasion.

For example, in FIG. 11, if a quantity of skew remains in such a manner that the left side of the forward edge PF of the sheet is moving forward faster, correction is made in the skew correction control by the registration rollers 201 and 202 in advance at the time of carrying another sheet that follows or at the time of carrying a sheet on another occasion so that the left side of the forward edge PF of the sheet will become slower. Specifically, if the quantity of residual skew as a result of the skew correction control based on the detected quantity from the pair of sensors 701 is Δθ, the quantity of skew control is corrected in advance in such a manner that the quantity of skew decreases by Δθs at the time of carrying the next sheet. However, since the control may become unstable if it is Δθs≧Δθ, it is desirable to set Δθs<Δθ in order to stabilize the control.

In this embodiment, the case where the average speed V of the left and right ends of the forward edge PF of the sheet P is constant is described as an example. However, in order to accurately position the forward edge PF of the sheet at the position of an image formed by the image forming unit 23, it is necessary to adjust this average speed V.

Figure 12:
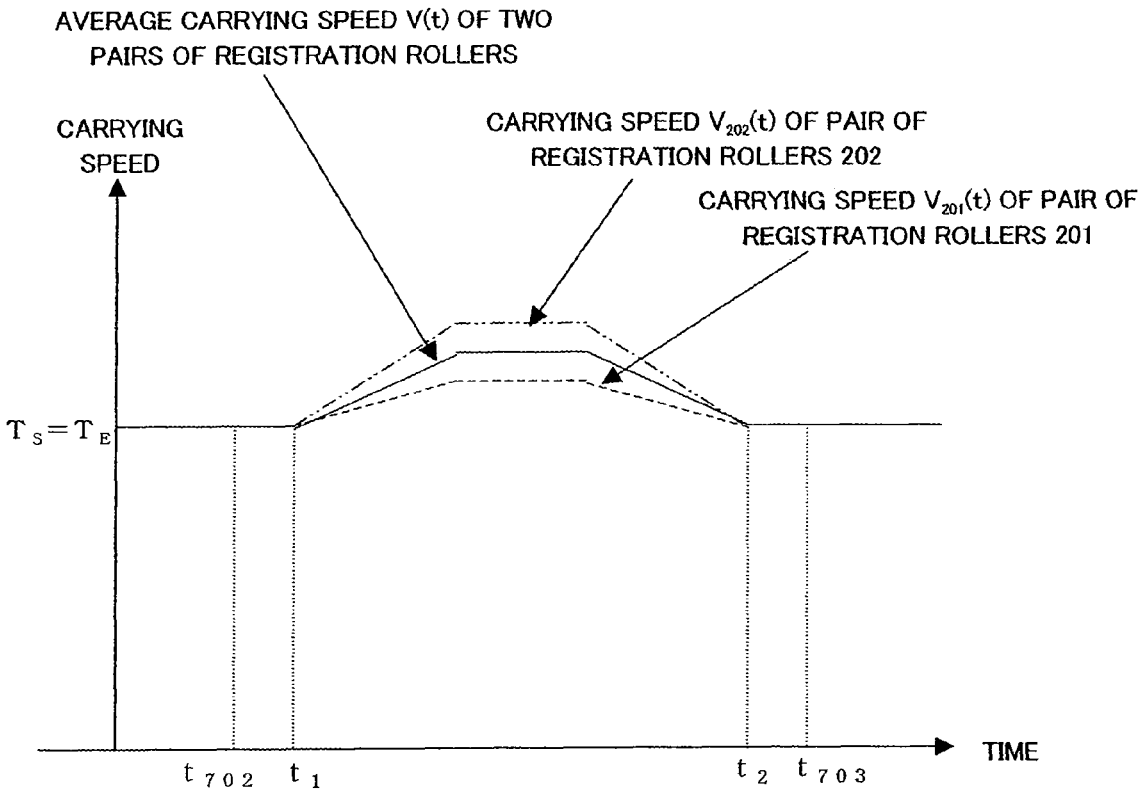
FIG. 12 is a graph showing the state of temporal change in the sheet carrying speed of registration rollers 201 and 202.

FIG. 12 is a graph showing the state of temporal change in the sheet carrying speed by the registration rollers 201 and 202. If the time when the left part of the forward edge PF of the sheet passes the sensor 702*b* is $t_{702b}$ and the time when the right part passes the sensor 702*a* is $t_{702a}$, the time when the central part of the forward edge PF of the sheet passes the position on a straight line connecting the pair of sensors 702, that is, $t_{702}$, is expressed as follows.

$$t_{702}=(t_{702a}+t_{702b})/2 \tag{7}$$

Similarly, if the time when the left side of the forward edge PF of the sheet passes the sensor 703*b* is $t_{703b}$ and the time when the right side passes the sensor 703*a* is $t_{703a}$, the time when the central part of the forward edge PF of the sheet passes the position on a straight line connecting the pair of sensors 703, that is, $t_{703}$, is expressed as follows.

$$t_{703}=(t_{703a}+t_{703b})/2 \tag{8}$$

In the graph, t, is the start time of the skew correction control and the image positioning control. It is set as immediately after the forward edge PF of the sheet passes the pair of sensors 702. In the graph, $t_2$ is the end time of the skew correction control and the image positioning control. It is set as immediately before the forward edge PF of the sheet reaches the pair of sensors 703.

In FIG. 12, the initial carrying speed VS of the registration rollers 201 is set to be equal to the carrying speed VE of the transfer rollers 911. After the skew correction control and the image positioning control are started at time $t_1$, the sheet carrying speed is controlled so that it is accelerated, then goes through a uniform-speed section, is then decelerated, and reaches the carrying speed VE of the transfer rollers 911 at time $t_2$. In the correction control section, the carrying speed of the pair of registration rollers 202 on the right side with respect to the carrying direction is higher than the carrying speed of the pair of registration rollers 201 on the left side. This is because the right side of the forward edge PF of the sheet with respect to the carrying direction is slower, as shown in FIG. 10.

The following integral value of the speed difference during the speed adjustment, $$\delta=\int\{V(t)-V_s\}dt \tag{9}$$

(where the integral range is from the skew correction start time t1 to the skew correction end time t2), means that a correction is made to allow the forward edge PF of the sheet to advance by the amount of displacement δ with respect to the developer image on the intermediate transfer body that is to be transferred by the transfer rollers 911.

As the time when the forward edge PF of the sheet reaches the pair of sensors 703 is delayed by Δt, if it is converted to displacement, it means that the sheet is shifted backward from the image by approximately δ=VSΔt.

In other words, the developer image is advanced with respect to the sheet. However, roller characteristics may change as they are used for a long time, and with such image positioning control alone, the correction accuracy may deteriorate.

Thus, the forward edge PF of the sheet is detected by the pair of sensors 703, and a position error (error corresponding to the above δ) after image positioning control is carried out is recognized. The quantity of sheet positioning speed adjustment is corrected at the time of carrying the subsequent sheet. For example, from the difference between the passing time $t_{703}$ of the forward edge PF of the sheet detected by the pair of sensors 703 and a reference passing time $T_{703}$ with respect to δ in the above equation (9), the delay of the sheet P with respect to the developer image is expressed as follows.

$$\Delta\delta = V_s \times \Delta T_{703} \tag{10}$$

Based on this information, the quantity of control is corrected at the time of carrying the next sheet by holding the following relation.

$$\delta' = \delta + \alpha \times \Delta\delta \tag{11}$$

Here, stability improves if the coefficient α is not set at 1 but at a slightly smaller value.

As described above, according to this embodiment, by arranging two pairs of sheet detection sensors between the skew correction means and the image scanning apparatus or image forming apparatus provided downstream thereof, it is possible to restrain deterioration with time both in skew correction control and in sheet carrying speed control.

In the technique described in Japanese Patent No. 3323758, since the skew correction section is divided into two or more in the carrying direction in order to perform control, the skew correction section for one correction is short. Particularly when the quantity of skew of the sheet is large in the first skew correction section, a large skew correction must be made in the short section and there is a problem that creases tend to be generated on the sheet. On the other hand, according to this embodiment, since the skew correction section can be made relatively long, the generation of creases on the sheet can be restrained.

Each step in the processing in the above sheet carrying device is realized as a sheet carrying program stored in the memory 802 is executed by the CPU 801.

In this embodiment, the case is described where the functions to carry out the invention have been recorded in advance in the device. However, the provision of the functions is not limited to this. The similar functions may be downloaded to the device from a network. Alternatively, the similar functions stored in a storage medium may be installed to the device. The recording medium may be any form of recording medium that can store programs and is readable by the device, such as a CD-ROM. The functions thus acquired by installation or downloading in advance may be realized in cooperation with the operating system (OS) in the device.

The specific embodiments of the invention have been described in detail. However, it will be obvious to those skilled in the art that various changes and modifications can be made without departing from the scope and spirit of the invention.

As described above in detail, according to the invention, a technique can be provided that can realize highly accurate skew correction without employing any particularly complicated device configuration.

What is claimed is:

1. A sheet carrying device comprising:

first and second rollers arranged at different positions from each other in a direction orthogonal to a sheet carrying direction, each of which can be separately driven to rotate;

a first pair of sensors including at least two sensors arranged in an upstream vicinity of the first and second rollers in the sheet carrying direction and arrayed in the direction orthogonal to the sheet carrying directions;

a second pair of sensors including at least two sensors arranged in a downstream vicinity of the first and second rollers in the sheet carrying direction and arrayed in the direction orthogonal to the sheet carrying direction;

a first skew determining unit configured to determine a quantity of skew of the sheet in accordance with a detection result from the first pair of sensors;

a first control unit configured to separately control driving of each of the first and second rollers to carry the sheet in such a manner as to reduce the quantity of skew determined by the first skew determining unit;

a second skew determining unit configured to determine a quantity of skew of the sheet in accordance with a detection result from the second pair of sensors; and a second control unit configured to separately control driving of each of the first and second rollers to carry the sheet in such a manner as to reduce the quantity of skew determined by the second skew determining unit.

2. The sheet carrying device according to claim 1, wherein when the sheet with its downstream edge in the sheet carrying direction detected by the first pair of sensors enters nips of the first and second rollers, the first control unit makes rotation speeds of the first and second rollers different from each other in order to correct the skew of the sheet.

3. The sheet carrying device according to claim 1, comprising:

a third pair of sensors including at least two sensors arranged in a downstream vicinity of the second pair of sensors in the sheet carrying direction and arrayed in the direction orthogonal to the sheet carrying direction;

a third skew determining unit configured to determine a quantity of skew of the sheet in accordance with a detection result from the third pair of sensors; and a third control unit configured to separately control driving of each of the first and second rollers in such a manner as to reduce the quantity of skew determined by the third skew determining unit.

4. The sheet carrying device according to claim 3, wherein a distance in the sheet carrying direction from nips of the first and second rollers to the third pair of sensors is shorter than the length of the sheet to be carried in the sheet carrying direction.

5. The sheet carrying device according to claim 1, wherein in the case where the quantity of skew determined by the first skew determining unit is equal to or more than a predetermined value, the first control unit reduces the sheet carrying speed of the first and second rollers, compared to the case where the quantity of skew determined by the first skew determining unit is less than the predetermined value, and thus causes the first and second rollers to perform skew correction.

6. The sheet carrying device according to claim 1, wherein in the case where the quantity of skew determined by the first skew determining unit is equal to or more than a predetermined value, the first control unit causes the first and second rollers to stop carrying the sheet.

7. The sheet carrying device according to claim 1, comprising an information acquiring unit configured to acquire information about the type of the sheet to be carried in the sheet carrying device, wherein in accordance with the information acquired by the information acquiring unit, the first control unit carries out mode switching between a first mode in which in the case where the quantity of skew determined by the first skew determining unit is equal to or more than a predetermined value, the first control unit reduces the sheet carrying speed of the first and second rollers, compared to the case where the quantity of skew determined by the first skew determining unit is less than the predetermined value, and thus causes the first and second rollers to perform skew correction, and a second mode in which in the case where the quantity of skew determined by the first skew determining unit is equal to or more than the predetermined value, the first control unit causes the first and second rollers to temporarily stop carrying the sheet and then resume carrying the sheet.

8. The sheet carrying device according to claim 1, further comprising a control quantity correcting unit configured to correct a quantity of control at the time of skew correction control by the first and second control units with respect to a sheet carried subsequently to the sheet in question, in accordance with a difference between the quantity of skew determined by the first skew determining unit on the basis of a detection result from the first pair of sensors with respect to a downstream end in the sheet carrying direction of the sheet to be carried, and the quantity of skew determined by the first skew determining unit on the basis of a detection result from the first pair of sensors with respect to an upstream end in the sheet carrying direction of the sheet carried by the first and second rollers in a state where skew correction control by the first control unit is not carried out.

9. An image forming apparatus comprising:

the sheet carrying device according to claim 1; and a transfer roller that transfers a developer image to a sheet carried by the sheet carrying device;

wherein the second pair of sensors is arranged upstream of the transfer roller in the sheet carrying direction.

10. A sheet carrying method for a sheet carrying device including first and second rollers arranged at different positions from each other in a direction orthogonal to a sheet carrying direction, each of which can be separately driven to rotate, a first pair of sensors including at least two sensors arranged in an upstream vicinity of the first and second rollers in the sheet carrying direction and arrayed in the direction orthogonal to the sheet carrying directions, and a second pair of sensors including at least two sensors arranged in a downstream vicinity of the first and second rollers in the sheet carrying direction and arrayed in the direction orthogonal to the sheet carrying direction, the method comprising:

determining a quantity of skew of the sheet in accordance with a detection result from the first pair of sensors;

separately controlling driving of each of the first and second rollers to carry the sheet in such a manner as to reduce the quantity of skew determined in accordance with the detection result from the first pair of sensors;

determining a quantity of skew of the sheet in accordance with a detection result from the second pair of sensors; and separately controlling driving of each of the first and second rollers to carry the sheet in such a manner as to reduce the quantity of skew determined in accordance with the detection result from the second pair of sensors.

11. The sheet carrying method according to claim 10, wherein when the sheet with its downstream edge in the sheet carrying direction detected by the first pair of sensors enters nips of the first and second rollers, rotation speeds of the first and second rollers are made different from each other in order to correct the skew of the sheet.

12. The sheet carrying method according to claim 10, wherein the sheet carrying device further comprises a third pair of sensors including at least two sensors arranged in a downstream vicinity of the second pair of sensors in the sheet carrying direction and arrayed in the direction orthogonal to the sheet carrying direction, a quantity of skew of the sheet is determined in accordance with a detection result from the third pair of sensors, and driving of each of the first and second rollers is separately controlled in such a manner as to reduce the quantity of skew determined in accordance with the detection result from the third pair of sensors.

13. The sheet carrying method according to claim 12, wherein a distance in the sheet carrying direction from nips of the first and second rollers to the third pair of sensors is shorter than the length of the sheet to be carried in the sheet carrying direction.

14. The sheet carrying method according to claim 10, wherein in the case where the quantity of skew determined in accordance with the detection result from the first pair of sensors is equal to or more than a predetermined value, the sheet carrying speed of the first and second rollers is reduced, compared to the case where the quantity of skew determined in accordance with the detection result from the first pair of sensors is less than the predetermined value, and thus the first and second rollers is caused to perform skew correction.

15. The sheet carrying method according to claim 10, wherein in the case where the quantity of skew determined in accordance with the detection result from the first pair of sensors is equal to or more than a predetermined value, the first and second rollers are caused to stop carrying the sheet.

16. The sheet carrying method according to claim 10, wherein information about the type of the sheet to be carried is acquired, and in accordance with the acquired information, mode switching is carried out between a first mode in which in the case where the quantity of skew determined in accordance with the detection result from the first pair of sensors is equal to or more than a predetermined value, the sheet carrying speed of the first and second rollers is reduced, compared to the case where the quantity of skew determined in accordance with the detection result from the first pair of sensors is less than the predetermined value, and thus the first and second rollers are caused to perform skew correction, and a second mode in which in the case where the quantity of skew determined in accordance with the detection result from the first pair of sensors is equal to or more than the predetermined value, the first and second rollers are caused to temporarily stop carrying the sheet and then resume carrying the sheet.

17. The sheet carrying method according to claim 10, wherein a quantity of control at the time of skew correction control with respect to a sheet carried subsequently to the sheet in question is corrected in accordance with a difference between the quantity of skew determined on the basis of a detection result from the first pair of sensors with respect to a downstream end in the sheet carrying direction of the sheet to be carried, and the quantity of skew determined on the basis of a detection result from the first pair of sensors with respect to an upstream end in the sheet carrying direction of the sheet carried by the first and second rollers in a state where skew correction control is not carried out.

* * * * *